US010600593B2

(12) United States Patent
Falkingham

(10) Patent No.: US 10,600,593 B2
(45) Date of Patent: Mar. 24, 2020

(54) VACUUM SWITCHING DEVICES

(71) Applicant: S&C Electric Company, Chicago, IL (US)

(72) Inventor: Leslie Thomas Falkingham, Rugby (GB)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 16/443,146

(22) Filed: Jun. 17, 2019

(65) Prior Publication Data

US 2019/0304721 A1 Oct. 3, 2019

Related U.S. Application Data

(60) Division of application No. 14/808,517, filed on Jul. 24, 2015, which is a continuation of application No. PCT/GB2015/050255, filed on Jan. 30, 2015.

(30) Foreign Application Priority Data

Feb. 3, 2014 (GB) ..... 1401824.6
Nov. 14, 2014 (GB) ..... 1420303.8

(51) Int. Cl.
*H01H 9/20* (2006.01)
*H01H 33/666* (2006.01)
*H01H 33/38* (2006.01)

(52) U.S. Cl.
CPC ..... *H01H 33/666* (2013.01); *H01H 9/20* (2013.01); *H01H 33/38* (2013.01); *H01H 33/6662* (2013.01)

(58) Field of Classification Search
CPC .. H01H 33/666; H01H 33/6662; H01H 33/38; H01H 9/20; H01H 33/662
See application file for complete search history.

(56) References Cited

U.S. PATENT DOCUMENTS 3,944,771 A 3/1976 Kohler
3,969,598 A * 7/1976 Sofianek ..... H01H 33/14 218/118

(Continued)

FOREIGN PATENT DOCUMENTS

CN 1381855 A 11/2002
CN 102687227 A 9/2012

(Continued)

OTHER PUBLICATIONS

International Search Report for International Application No. PCT/GB2015/050255 dated Jul. 5, 2015.

(Continued)

*Primary Examiner* — Truc T Nguyen

(57) ABSTRACT

An alternating current vacuum switching device for switching an electrical circuit under load and no load conditions, and optionally short-circuit conditions is disclosed. The switching device comprises: a vacuum evacuated housing; first and second electrodes within the housing; and an actuator for moving the first electrode relative to the second electrode to mechanically engage and disengage the electrodes to perform a switching function, wherein the first electrode is wholly located within the vacuum evacuated housing such that movement of the switching function occurs solely within the housing. By having movement of the switching function solely within the housing, the reliability of the vacuum switching device is improved.

11 Claims, 8 Drawing Sheets

(56) References Cited

U.S. PATENT DOCUMENTS

| | | | | |
|---|---|---|---|---|
| 4,272,661 | A | 6/1981 | Dethlefsen | |
| 4,276,455 | A | 6/1981 | Kimblin | |
| 5,206,616 | A | 4/1993 | Stegmuller | |
| 5,834,725 | A | 11/1998 | Clarke | |
| 8,497,446 | B1 * | 7/2013 | Glaser | H01H 33/666 218/118 |
| 8,912,871 | B2 | 12/2014 | Lauraire | |
| 8,952,826 | B2 | 2/2015 | Luccia | |
| 2002/0036184 | A1 | 3/2002 | Sohn | |
| 2004/0093718 | A1 | 5/2004 | Takeuchi | |
| 2004/0099639 | A1 | 5/2004 | Valdermarsson | |
| 2004/0118815 | A1 | 6/2004 | Marchand | |
| 2005/0067380 | A1 | 3/2005 | Rhein | |
| 2008/0302765 | A1 | 12/2008 | Renz | |
| 2009/0284334 | A1 | 11/2009 | Kim | |
| 2011/0042354 | A1 | 2/2011 | Blalock | |
| 2012/0274428 | A1 * | 11/2012 | Reuber | H01H 33/66207 335/6 |
| 2013/0213939 | A1 * | 8/2013 | Gentsch | H01H 33/12 218/140 |
| 2014/0158665 | A1 | 6/2014 | McCord | |
| 2014/0175058 | A1 * | 6/2014 | Gentsch | H01H 1/5822 218/124 |
| 2015/0303010 | A1 | 10/2015 | Yu | |
| 2015/0332884 | A1 * | 11/2015 | Lee | H01H 83/02 361/42 |
| 2017/0062155 | A1 * | 3/2017 | Cary | H01H 33/42 |
| 2019/0252139 | A1 * | 8/2019 | Falkingham | H01H 33/664 |

FOREIGN PATENT DOCUMENTS

| | | |
|---|---|---|
| DE | 19808083 | 4/1999 |
| EP | 1719813 | 10/2006 |
| JP | S52-137040 | 10/1977 |
| JP | S59-203325 | 11/1984 |
| JP | S59203327 | 11/1984 |
| JP | S60205931 | 10/1985 |
| JP | H11345547 | 12/1999 |

OTHER PUBLICATIONS

Written Opinion for International Application No. PCT/GB2015/050255 dated Jul. 5, 2015.

The Chinese Office Action dated Feb. 26, 2019, for the Chinese Patent Application No. 2015800004931 and the English translation of the same.

The Japanese Office Action dated Dec. 13, 2019, issued for the Japanese Patent Application No. 2016-567167 and the English translation of the same.

* cited by examiner

VACUUM SWITCHING DEVICES

CROSS-REFERENCE TO A RELATED APPLICATION

This application is a divisional of U.S. application Ser. No. 14/808,517 filed Jul. 24, 2015, which is a continuation of International Application PCT/GB2015/050255 filed Jan. 30, 2015, which claims the benefit of the filing date of British Patent Application No. 1401824.6, filed Feb. 3, 2014, and British Patent Application No. 1420303.8. filed Nov. 14, 2014, which are all hereby incorporated herein by reference in their entirety.

FIELD

The invention describes vacuum switching devices. In particular, vacuum switching devices for switching an electrical circuit under load and no load conditions, and optionally short-circuit conditions, are described.

BACKGROUND

Vacuum switching devices are utilised in most modern medium voltage electrical installations. Vacuum switching devices are typically employed as part of a switchgear which is a broad term for the combination of electrical components used to control, protect and isolate electrical equipment and circuits. Switchgear generally comprise a switching device, such as a vacuum interrupter, an actuator for exerting and applying a force to switch the switching device and a detection system for detecting a switching requirement (including faults) in the electrical equipment/circuit.

Vacuum switching devices, commonly called vacuum interrupters, are well established as highly suited as the switching device in switchgear. A known vacuum interrupter is shown in FIG. 1. A vacuum interrupter of the type shown in FIG. 1 typically comprises an evacuated envelope or housing 10 formed by an insulating component 12 and metal end plates 14, 16. The housing 10 encloses a fixed electrode 20 and a moveable electrode 22 that are designed to engage and disengage mechanically to perform a switching function. Normally this movement is permitted without breaking the seal of the evacuated envelope 10 by means of a bellows or diaphragm arrangement 24. Typically each electrode comprises a contact assembly or contact 26, 28 coupled to a conducting rod which is called a rod or stem 30, 32.

A problem with existing vacuum interrupters is that the bellows or diaphragm arrangement is a weak point within the device. As the bellows both provide for the movement of the stem, and therefore the movement of the movable electrode/contact, and are part of the housing, after multiple actuations the bellows can wear out and fail. Typically, this failure leads to loss of vacuum within the housing. Due to the relatively large voltages employed, typically 1000V-50 kV, loss of vacuum in this manner causes a loss of insulation effect of the vacuum interrupter due to the Paschen's law. This causes the vacuum interrupter to fail to interrupt at the required low current. The success of vacuum interrupters has also led to many of the devices being in use for decades, much longer than their original intended usage, resulting in a higher risk of such mechanical failure than originally accounted for.

Vacuum interrupters and similar functioning devices are the key components within electrical switchgear, which may form or be part of a circuit breaker or motor control centre or other switching device. In present designs of switchgear an actuator is connected mechanically to the moving electrode (typically via the connecting rod or stem) of the vacuum switching device and acts to engage or disengage the moving electrode with the fixed electrode by acting on the stem. Conventionally, multiple vacuum interrupters are required for an electrical installation which often is a three phase circuit with one or more vacuum interrupters per phase, and a single actuator can then be used to actuate multiple vacuum interrupters. Consequently, the actuators used tend to be large and require additional components or multiple connections to each stem. Actuators may be of several types including magnetic, spring, hydraulic or pneumatic.

In the literature smaller actuators located within an evacuated chamber are described and may be used in some one-use switching or breaker devices. However, such devices are either direct current devices and/or low voltage devices and are unsuited to alternating current and/or medium voltage regimes due to unpredictable or unreliable switching behaviour under such conditions. Smaller actuators typically described in such breakers include Thomson coil actuators. However, such actuators are not of practical use in alternating current vacuum switching devices and their associated switchgear because the force generated for actuation relies on the inducement of eddy currents within conducting discs, which then repel and move an associated contact. However, the force required is too low for actuators used in alternating current and medium voltage regime switching devices. Furthermore, the eddy current is produced by changes in the magnetic field of the coil current, so the force only sustains while the coil current is changing. If the current changes by increasing, it soon gets too large to be provided by the supply, and if it changes by decreasing, it soon reaches zero. Thus the force is time limited. By contrast in a conventional magnetic actuator the force profile over time can be tailored to requirements by shaping a pulse of coil current, and can be continued indefinitely if required. Such smaller actuators, such as Thomson coil actuators also do not allow latching of a switch in an open or closed position because it requires a constantly changing magnetic field, reinforcing their intended use in breakers and single use devices. Finally, when large short circuit current is to be interrupted, this condition will induce large eddy currents which will interfere with the operation of the Thomson coil. This could result in uncommanded operation of the switch or prevent a commanded operation with potential catastrophic effects if used in a switching device for medium voltage. Such uncommanded operations are specifically forbidden in International standards concerning switchgear.

In summary, for at least the reasons outlined above, an improved vacuum switching device is desired.

SUMMARY

According to a first aspect of the present invention, there is provided an alternating current vacuum switching device for switching an electrical circuit under load and no load conditions, and optionally short-circuit conditions, the switching device comprising: a vacuum evacuated housing; first and second electrodes within the housing; and an actuator for moving the first electrode relative to the second electrode to mechanically engage and disengage the electrodes to perform a switching function, wherein the first electrode is wholly located within the vacuum evacuated housing such that movement of the switching function occurs solely within the housing.

Provision of an alternating current vacuum switching device as defined above breaks the traditional link between the moving switching components and the housing, allowing the traditional bellows used to be removed. Such an arrangement provides numerous advantages. It removes mechanical strain on the housing, greatly simplifying the mechanical design of any accompanying switchgear and reducing the likelihood of mechanical failure of the housing during switching. This prolongs the expected life of the device.

By wholly locating the moving components, namely the first electrode, within the vacuum housing, it is intended that the electrode is completely under vacuum, so is enclosed within the housing. Accordingly, the vacuum switching device is designed to have no external moving parts.

Additionally, by providing a switching device as defined above, where the moving components, namely the first electrode, are located solely or wholly within the housing, the device may be considered to be self-actuating, that is it does not require a bulky external actuator to perform the switching function. This reduces the size of switchgear necessary to control the switching device and allows for mechanical decoupling of the switching device from the switchgear. Furthermore, it avoids the use of bellows or a diaphragm arrangement and the associated disadvantages inherent with these.

The removal of any external moving components also allows for a lower level of fitter skill required to install the device without damaging or twisting the fragile bellows. Installation is also simplified by allowing simple standard electrical connections to be made to it, at a fixed separation.

For outside use the switching device may be enclosed in an insulating container which contains an insulating gas or liquid. Alternatively the switching device may be encapsulated in an insulating material such as plastic. The design of these arrangements is greatly simplified if there is no external part whose movement has to be accommodated.

It is to be appreciated that wholly locating the first electrode within the housing is particularly useful for alternating current switching devices as defined above because no moving parts pass through the vacuum boundary defined by the housing, which typically provides a common failure weakness.

In addition the invention has the effect of considerably simplifying the design of the circuit breaking device into which the vacuum switching device is fitted. In existing arrangements the switching device is at the high voltage being switched, and the actuator is generally at earth potential, and so a drive insulator is required which is made of insulating material and acts to transfer mechanical force between the two.

The first and second electrodes may be mutually opposed to minimise the travel of the electrodes during a switching event. In other examples, the second electrode may be wholly located within the vacuum evacuated housing.

In embodiments of the present invention, the electrode may comprise only a contact directly actuated by the force exerted by the actuator. Typically, in existing designs a flexible or sliding electrical connection is needed between the moving electrode stem and a fixed busbar. However, by removing the need for a drive insulator, such a flexible or sliding electrical connection is no longer essential due to the ability to directly drive the electrode using the actuator. By eliminating this requirement the switching device can be installed more simply by fixing both of its ends directly to their busbars.

Furthermore, in conventional switchgear the fixed contact end has to be held sufficiently rigidly that the interrupter or switch is held firm against the switching force provided by the (external) actuator. This is achieved by a rigid and firmly located busbar or otherwise. In embodiments of the present invention, by containing the mechanical forces exerted by the actuator within the confines of the housing, only the weight of the device requires external support, simplifying the design of the external connections and mountings.

The actuator has to be able to quickly pull the contacts of the device apart against the inertia of the moving components/parts (electrodes) and the drive (the actuator, optionally via an insulator) and it has to be able to quickly push the contacts together again and hold them together with a force sufficient to overcome the throw-off force which arises when two current carrying conductors make an end-to-end contact. Another advantage is that the inertia of the drive insulator used in prior art devices and its associated components is eliminated, which reduces the actuator force required. In the prior art the actuator also has to act against the force of air pressure acting over the area of the bellows, and this complication is eliminated by the above arrangement.

In embodiments, the first electrode can move independently of the housing. This arrangement further isolates the moving components from the housing, ensuring that the housing is not subject to mechanical wear during switching of the device. Furthermore, the housing may be entirely rigid such that the housing contains no flexible or moveable parts.

In embodiments, operation of the actuator on the first rod can be effected through the housing. For example, operation of the actuator may be via a magnetic field acting through the housing to displace the first contact via the first rod towards the second contact to make and break the mechanical connection.

The actuator may be located at least partially within the housing. In such embodiments, the actuator is incorporated into the design of the vacuum switching device with part or all of it inside the vacuum envelope. For example, poles of a permanent magnet actuator may be located inside the housing. This can allow a direct actuation of the first electrode by the actuator and can provide a more compact arrangement for the switching device.

In some embodiments, the moving parts of the actuator are located within the housing. In such devices, the first electrode may be considered to be the actuation rod of the actuator. This ensures that there are no external moving parts that may be at a greater risk of mechanical failure or require regular maintenance. Some embodiments may also include locating the fixed parts of the actuator on the outside of the housing. In a similar manner, this allows access to at least part of the actuator for maintenance.

Different embodiments may utilise different types of actuator designed into the switching device. Examples of such actuators include the form of a spring mechanism, a solenoid mechanism, a permanent magnet mechanism or other mechanisms. Each mechanism may include a mechanical or magnetic latch or latches to hold the moving contact in the open or closed position.

The first electrode may be latched by the actuator in a first position when the contacts are disengaged, and in a second position when the contacts are engaged. Such latching ensures that the first electrode is held in position relative to the second electrode either in engagement where required, or at a correct distance from each other tailored to the breakdown voltage necessary for vacuum switching in a disengaged position. Preferably, the first electrode is magnetically latched by the actuator. Magnetic latching again minimises the number of mechanical or moving parts within the device, improving device lifetime.

In some examples, the actuator is a permanent magnet actuator. In such embodiments, the first electrode and the actuator together can be considered to be forming a permanent magnet actuator. A permanent magnet actuator is ideally suited to use in the switching device due to low maintenance requirements and the ability to quickly and reliably switch hundreds or thousands of times with minimum maintenance. Additionally permanent magnet actuators are able to actuate in the medium voltage and vacuum conditions required.

The permanent magnet actuator may comprise one or more electrical windings disposed externally to the housing such that excitation of the electrical windings moves the first electrode relative to the coils. Placing the electrical windings outside of the housing allows the windings to be replaced as necessary and the field strength of the magnetic field generated by the permanent magnet actuator to be tailored at a later stage. Alternatively (or additionally) the permanent magnet actuator can comprise one or more electrical windings disposed within the housing such that excitation of the electrical windings moves the first electrode relative to the coils. Locating at least some of the windings within the vacuum evacuated housing prevents exposure to grime and accumulated dirt and ensures a reliable magnetic field is generated throughout the lifetime of the device.

Based on the embodiments described above, the actuator may exert a force on the first electrode through the housing, at least partially. Alternatively or additionally, the actuator may exert a force on the first electrode either solely or at least partially from within the housing. Where the actuator is a magnetic actuator the housing may be made from a magnetically transparent material. This allows the actuator to be provided external to the housing and exert a force on the first electrode through the housing, whilst ensuring that no of the switching components occurs external to the housing. Stainless steel is one example of a material that could be used as a magnetically transparent housing, but other materials are also available.

In such examples including a permanent magnet actuator, the first electrode can be magnetically latched by the permanent magnet actuator in a first position when the contacts are disengaged, and in a second position when the contacts are engaged.

The first electrode may be constrained to move only towards and away from the second electrode in a planar direction, i.e. along a single axis. Guide means may be employed to perform the constraint. By minimising the rotational or angular movement of the first rod, the reliability of the device is improved The first electrode can comprise a first rod coupled to a first contact, wherein the first rod is configured to be moved by the actuator. Movement of the first rod then also moves the first contact. In such embodiments, the first rod may form part of the actuator.

Typically, the first contact and the first rod can be a unitary component. This ensures a consistent and direct coupling of the force applied by the actuator to the first contact. Such an arrangement of the first contact and the first rod may be referred to as an electrode. However, it can be envisaged that the first contact and the first rod are not mechanically coupled, only operationally coupled such that movement of the rod indirectly moves the first contact. Additionally, the first rod may form part of the first contact such that the first contact is directly actuated by the actuator. A similar configuration may be utilised for the second electrode such that the second electrode comprises a second contact and a second rod.

In some examples, the position of the second electrode can be fixed with respect to the housing. For example, the second electrode, or where present the second contact, may be locatably fixed to the housing by a second rod. In this instance the second electrode may be considered to be a fixed electrode and the first electrode a moving electrode. However, it can be appreciated that the second electrode may be moveable in other embodiments, for example by using a second actuator coupled to the second electrode, such as by the second rod.

In a second aspect of the present invention, there is provided an electrical arc vacuum switching device for switching an electrical circuit under load and no load conditions, and optionally short-circuit conditions, the switching device comprising: a vacuum evacuated housing; and switching components for performing a switching function, wherein any moving elements of the switching components are located within the housing.

In the second aspect, the switching components may be considered to be the actuator and the first and second electrodes of any embodiment of the first aspect. Similarly, the vacuum evacuated housing may be considered to be analogous to the vacuum evacuated housing of the above described embodiments and examples of the first aspect.

In a third aspect of the present invention, there is provided an electrical switchgear comprising one of more vacuum switching devices according to the first or second aspects.

Utilising one or more of the vacuum switching devices of the first and second aspects in an electrical switchgear allows the electrical switchgear to be more compact, due to the absence of large external actuators for actuating one or more of the switching devices. Furthermore, as described above with relation to the first aspect, the benefits of providing a housing of a switching device free from external moving parts aids installation and maintenance.

In a fourth aspect of the present invention, there is provided a method of switching a vacuum switching device comprising: applying a magnetic field to a switch component held in a vacuum chamber to cause it to move from open to closed, or closed to open, conditions without moving a mechanical component that passes through the vacuum chamber.

This invention simplifies the vacuum sealing of the vacuum switching device and improves its reliability, because the bellows or diaphragm is the weakest point of the design and normally limits the mechanical life of the device.

These and other aspects of the invention will be apparent from, and elucidated with reference to, the embodiments described hereinafter.

BRIEF DESCRIPTION OF DRAWINGS

Embodiments will be described, by way of example only, with reference to the drawings, in which.

DETAILED DESCRIPTION OF EMBODIMENTS

Figure 8:
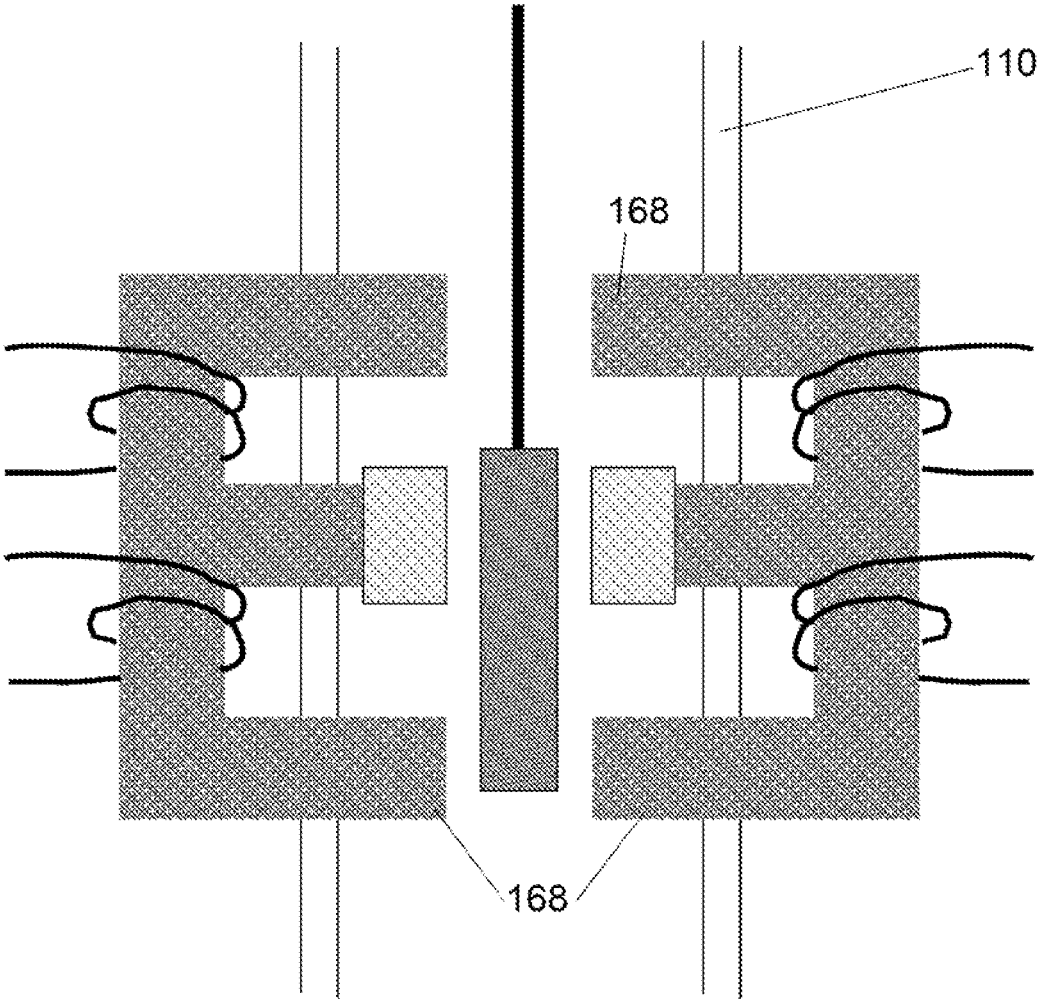
FIG. 8 illustrates an alternative permanent magnet actuator for use with embodiments of the present invention, such as that shown in FIG. 5.

As noted above in regards to FIG. 1, this invention removes the need for movement to be transmitted through the vacuum wall and so eliminates the need for a bellows or diaphragm. The principle of the invention is illustrated in FIGS. 5, 6 and 8, which are explained below.

Figure 2:
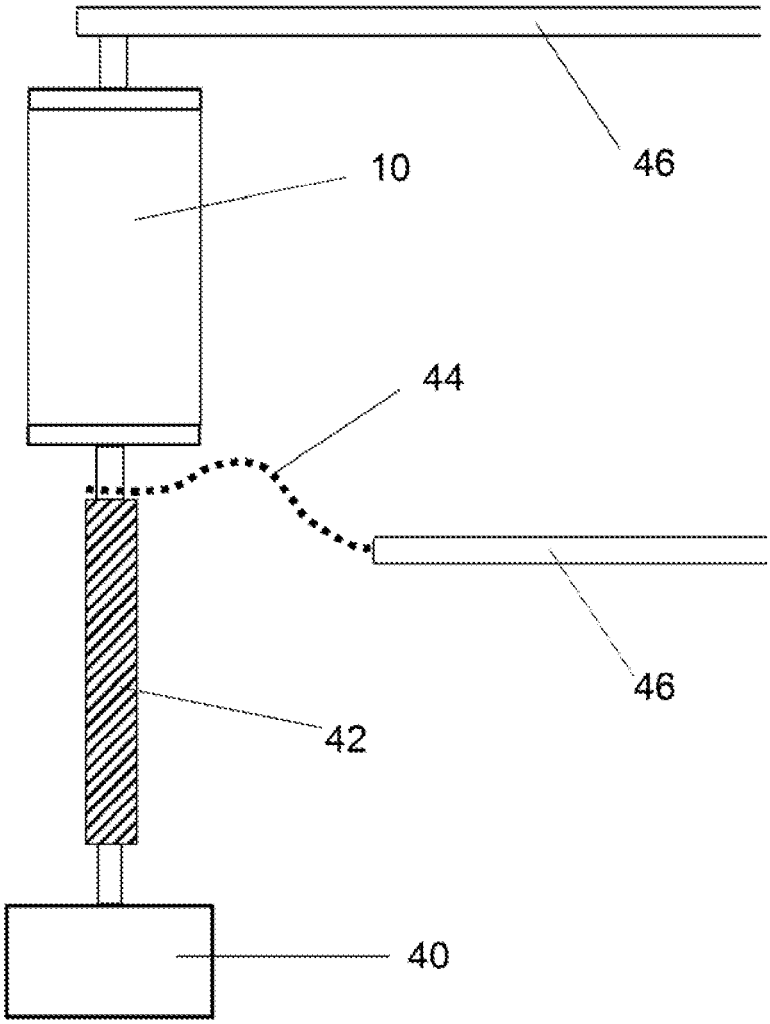
FIG. 2 illustrates a prior art switchgear including the vacuum switching device of FIG. 1.
Figure 3:
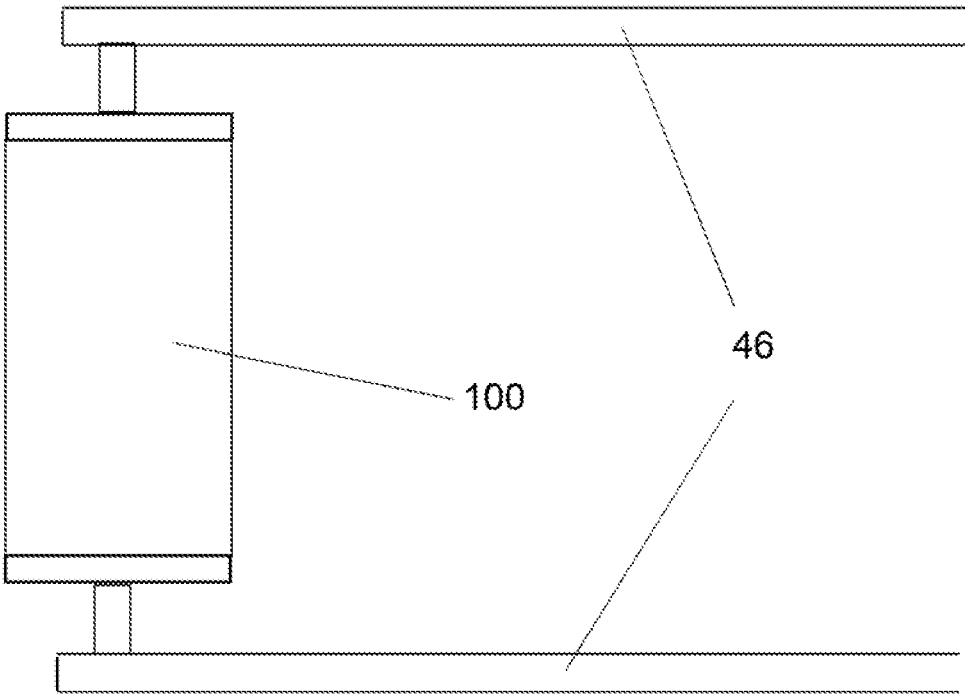
FIG. 3 illustrates the switching device according to the present invention.

The present invention has the effect of considerably simplifying the design of the circuit breaking device into which the vacuum switching device is fitted. In existing arrangements (FIG. 2) the switching device 10 is at the high voltage being switched, and the actuator 40 is generally at earth potential, and so a drive insulator 42 is required which is made of insulating material and acts to transfer mechanical force between the two. The drive insulator must be long enough so that it will not be shorted by high voltage arcing through the insulating medium around it, which may be air. By eliminating the need for a drive insulator the whole equipment becomes more compact and simplified. Also in existing designs a flexible or sliding electrical connection 44 is needed between the moving electrode stem and a fixed busbar 46. By eliminating this requirement the switching device can be installed simply by fixing both of its ends directly to their bus bars 46. FIG. 3 illustrates the simplified arrangement and shows a vacuum switching device 100 coupled directly to the bus bars 46.

Figure 4:
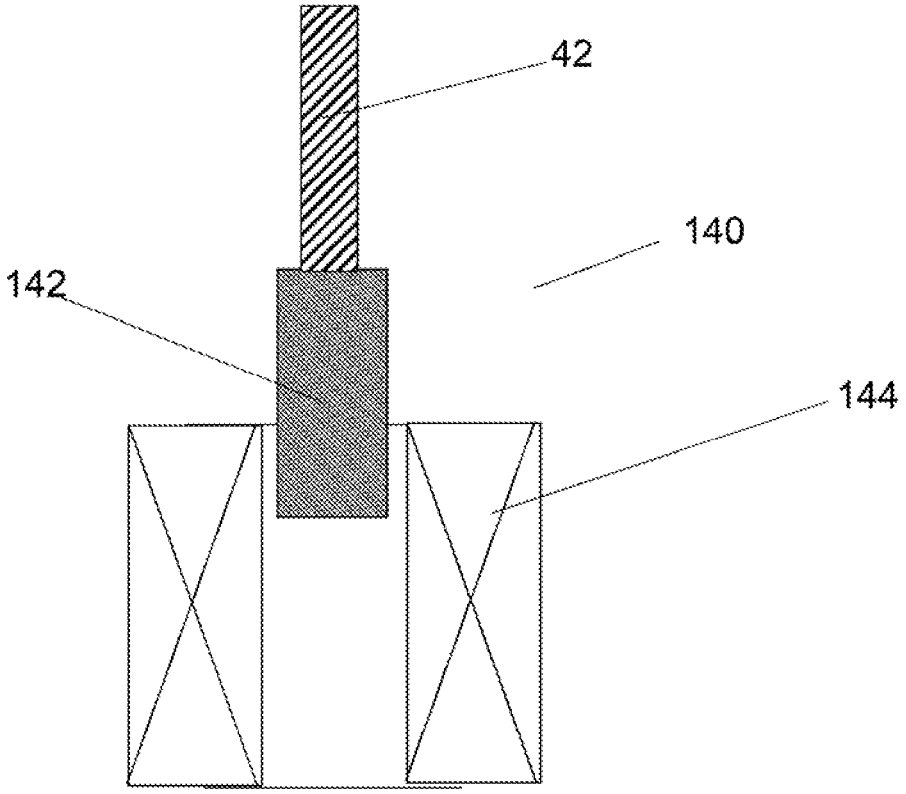
FIG. 4 illustrates a magnetic actuator for use in the present invention.

There are two forms of electromagnetic actuator widely used in this application. The first of these, known as a magnetic actuator or solenoid actuator, is shown in FIG. 4. Magnetic actuators 140 typically have a rod or stem 142 made of magnetisable material such as iron that is pulled into a solenoid coil 144. For example, in the prior art arrangement shown in FIGS. 1 and 2, this action of the stem 142 acts on the drive insulator 42 to pull the contacts 26, 28 apart and also to compress a spring (not shown) to latch the contacts. The spring force is used when the contacts are to be closed. The solenoid generally comprises at least one coil 144 and the stem or iron piece 142 although it may have additional magnetic circuit parts such as additional permanent magnets, and is activated by a specially formed pulse of high current, sufficient to overcome frictional effects, to energise the coils 144. Once the contacts 26, 28 are opened, the mechanism is magnetically or mechanically latched in that position, or it may be held open by a continuing activation current.

Figure 1:
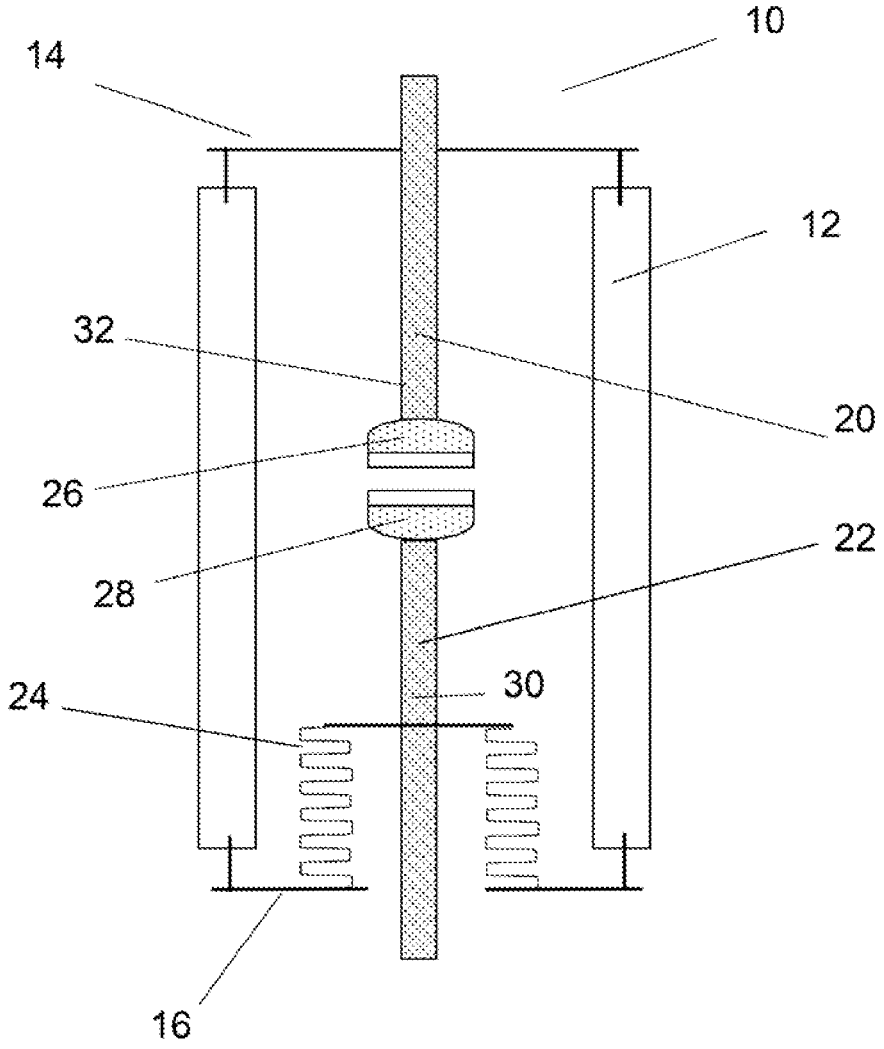
FIG. 1 illustrates a prior art vacuum switching device.
Figure 5:
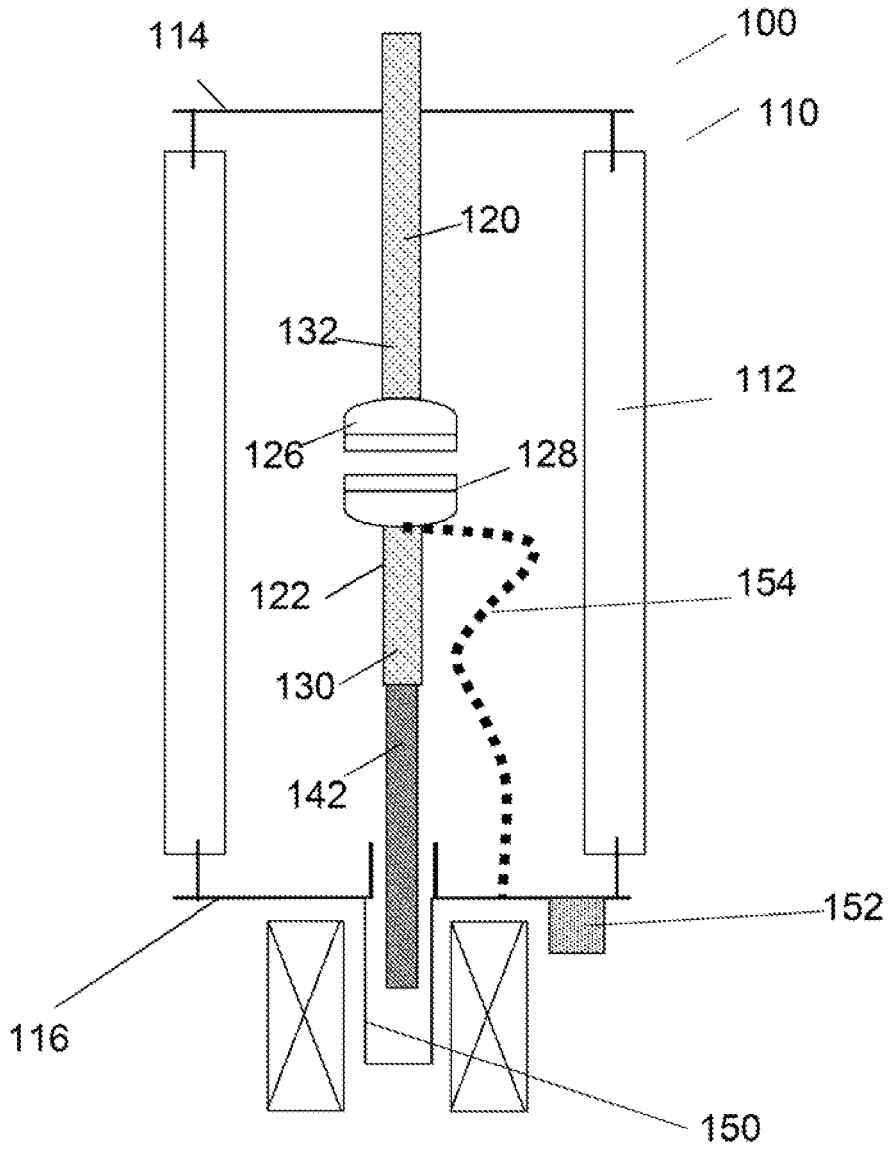
FIG. 5 illustrates an embodiment of a vacuum switching device according to the present invention.
Figure 6:
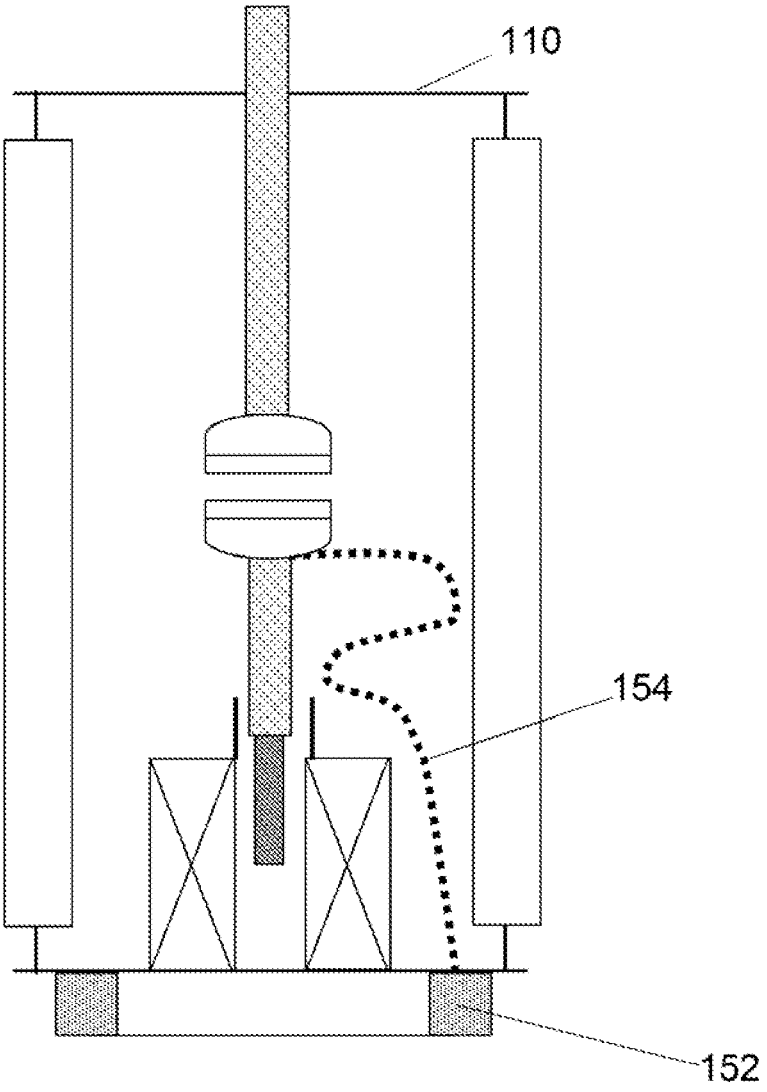
FIG. 6 illustrates an alternative embodiment of a vacuum switching device according to the present invention.

An example of the implementation of one form of actuator according to the invention is illustrated in FIG. 5. FIG. 5 shows a cross-sectional view of an embodiment of the vacuum switching device 100. One key difference between the switching device 100 and the device 10 shown in FIG. 1 is the lack of bellows or a diaphragm. Instead, the switching device has a housing 110 that has insulating sidewalls 112 that separate top 114 and bottom 116 plates to form the housing 110. The housing is shown as a cylinder, but other shapes and configurations are known and may be substituted. The insulating sidewall is typically a ceramic material, such as glass ceramic alumina, whilst the top and bottom plates are generally made of metal, typically stainless steel. Again, other materials may be used, such as copper, depending upon the characteristic properties required.

In the example shown in FIG. 5, the vacuum device 100 has two opposed electrodes 120, 122. The first electrode 120 is fixed with respect to the housing 110, whilst the second electrode 122 is able to move with respect to the housing 110. Crucially, the movement of the second electrode 122 occurs solely or wholly within the housing 110. The housing 110 itself does not move in addition to or with the second electrode 122.

The first and second electrodes 120, 122 respectively terminate in a first and second contact 126, 128. Once connected together, the first and second contacts 126, 128 make an electric circuit under normal load conditions. Alternatively, if the contacts are separated, once any arc is extinguished the circuit is broken. Accordingly, movement of the contacts acts as a switching device to make and break the electrical circuit. In order to extinguish any current arcs formed due to the high voltages typically used for such circuits, the housing is generally evacuated to a pressure of approximately $10^{-6}$ mbar/$10^{-4}$ Pa.

The second electrode 122 has a stem 130 coupled to a rod 142. The rod 142 is typically iron or any other material able to be magnetised. The iron part or rod 142 is located inside a closed protrusion 150 of generally magnetically transparent material, such as stainless steel or copper, which forms part of the vacuum housing 110 or envelope and which may extend beyond the normal end plate 116 of the envelope and into the solenoid coil 144, which is fixed to the end plate 116 of the vacuum container 100. In this manner, the actuator 144 exerts a force on the second electrode 122 through the housing, via the rod 142 and stem 130. It may be appreciated that the actuator can be considered to be acting through the wall of the housing to move the contact or electrode without effecting movement of the switching components external to the housing.

In another form of this implementation the vacuum envelope 110 is extended to include the whole solenoid 144 together with its iron piece 142, and wires 154 to the solenoid coil or coils pass through the vacuum envelope 110 (i.e. the wall of the vacuum chamber) as illustrated in FIG. 6. In a variant of this first actuator there are two coils, spaced so that activation of one will pull the iron piece 142 one way and activation of the other will pull the rod 142 the other way. This may also be implemented according to the invention as described with reference to FIG. 5.

Figure 7:
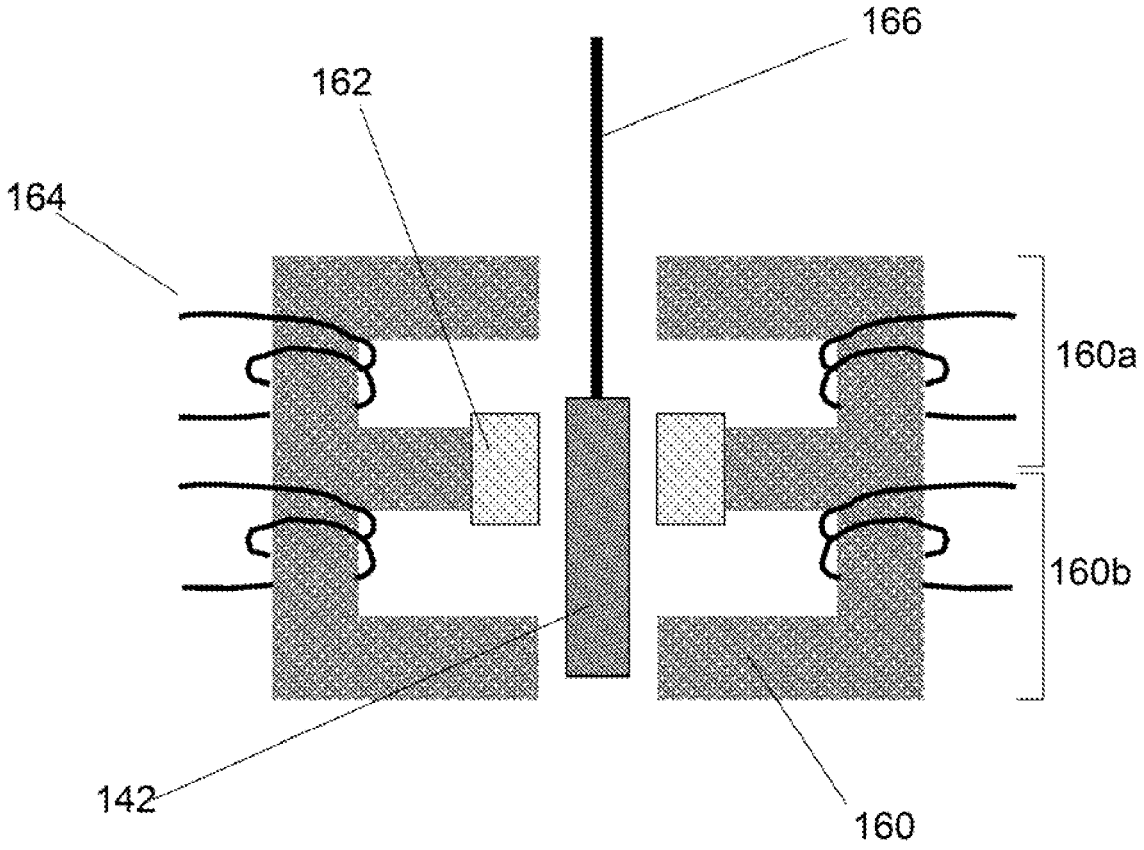
FIG. 7 illustrates a permanent magnet actuator for use with embodiments of the present invention, such as that shown in FIG. 6.

FIG. 7 illustrates a second form of widely used actuator, known as a permanent magnet actuator, in which the stem or part 142 made of magnetisable material such as iron is moved between two positions, corresponding to the contacts 126, 128 being in and out of electrical contact, by means of a magnetic circuit. A permanent magnet 162 included in the circuit acts to holds the iron piece 142 in either of the positions, namely to make (contacts 126, 128 are in contact) or break (contacts 126, 128 are separated) the electrical circuit. This allows the switching action of the device. Movement is generally performed by disturbing the magnetic circuit by means of a coil 164 that momentarily overcomes the magnetic attraction caused by the permanent magnet 162 and causes the iron piece 142 to move, for example, from one position to the other position where it is then held by the action of the permanent magnet 162. An example of this is shown in FIG. 7, in which the iron piece 142 acts together with a core of magnetisable material 160 in such a way that it can magnetically bridge one half or the other of the core. A permanent magnet 162 caps the central bar of the E shaped core 160. When the iron piece 142 is bridging the first half 160*a* of the core 160, magnetic flux from the magnet 162 flows around that half 160*a* of the core 160, and magnetic forces then hold the iron piece 142 in that position. A winding 164 around the other half 160*b* of the E core allows a pulse of current to momentarily oppose the magnetic force of the magnet and attract the iron piece 142 to that half 160*b* of the E core 160. The magnetic flux from the permanent magnet 162 then flows around this other half 160*b* of the E core, which has the effect of holding the iron piece 142 in the new position. The iron piece 142 can be moved back to its first position by a pulse of current in the first half 160*a* of the E core. The iron piece 142 is connected by a non-magnetic rod 166 to the drive insulator 122. One skilled in the art will appreciate that the core need not be in an E shape and that other shapes could be used.

For this form of actuator shown in FIG. 7, the invention may be implemented either by enclosing the iron piece 142 within a non-magnetic closed protrusion of the vacuum envelope as was shown in FIG. 5, or by putting the whole actuator inside the vacuum envelope 110 as was shown in FIG. 6, or by designing the assembly or housing 110 with part of the magnetic circuit 160 inside the vacuum envelope 110, while the part of the magnetic circuit which has coils 164 around it is outside the vacuum envelope 110, as shown in FIG. 8, in which a part of the vacuum envelope 110 is sealed around the limbs 168 of the E core 160. In another form of this implementation the vacuum envelope 110 is extended to include the whole actuator and connections to the solenoid coils 164 pass through the vacuum envelope 110, as was shown in FIG. 6.

In all these implementations of the invention a variety of latching mechanisms may be included and a variety of flexible or sliding connectors may be used to connect the fixed or first electrode 120 to the moving or second electrode 122. Additionally, it may be appreciated that both electrodes 120, 122 may move relative to each other. In such examples, the moving components of both electrodes 120, 122 (i.e. the switching components) can be wholly or solely confined within the vacuum evacuated housing 110.

According to the embodiments described above, the vacuum switching device, and in particular the vacuum housing, is designed to have no external moving parts. The actuator is incorporated into the design of the vacuum switching device with part or all of it inside the vacuum envelope and a flexible or sliding electrical connection 154 is provided within the vacuum envelope to connect the moving electrode to a conducting part of the vacuum envelope which has an external terminal 152 enabling a fixed electrical connection to the circuit being switched.

A person skilled in the art will appreciate that this invention may be applied in a number of ways to the vacuum switching device, but the underlying principle of a vacuum switching device with no external moving components remains.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar feature in modified and different embodiments.

From reading the present disclosure, other variations and modifications will be apparent to the skilled person. Such variations and modifications may involve equivalent and other features which are already known in the art of vacuum switching, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination. The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, and reference signs in the claims shall not be construed as limiting the scope of the claims.

The invention claimed is:

1. An alternating current vacuum switching device for switching an electrical circuit under load and no load conditions, and optionally short-circuit conditions, the switching device comprising:

a vacuum evacuated housing;

first and second electrodes within the vacuum evacuated housing; and an actuator for moving the first electrode relative to the second electrode to mechanically engage and disengage the electrodes to perform a switching function, wherein the first electrode is wholly located within the vacuum evacuated housing and at least a portion of the actuator is located within the vacuum evacuated housing, without the use of vacuum bellows, such that movement of the first contact relative to the second electrode consummate with a switching function occurs solely within the vacuum evacuated housing; wherein, the actuator comprises a magnetic actuator including a E-shaped core portion disposed at least partially within the vacuum evacuated housing.

2. The alternating current vacuum switching device of claim 1, wherein the E-shaped core portion comprises limbs extending into the vacuum evacuated housing.

3. The alternating current vacuum switching device of claim 1, wherein the E-shaped core portion comprises a wire-wound base portion.

4. The alternating current vacuum switching device of claim 3, wherein the base portion is outside the vacuum evacuated housing.

5. The alternating current vacuum switching device of claim 1, wherein the E-shaped core portion is entirely disposed within the vacuum evacuated housing.

6. An alternating current vacuum switching device for switching an electrical circuit under load and no load conditions, and optionally short-circuit conditions, the switching device comprising:

a vacuum evacuated housing;

first and second electrodes within the vacuum evacuated housing; and an actuator for moving the first electrode relative to the second electrode to mechanically engage and disengage the electrodes to perform a switching function, wherein the first electrode is wholly located within the vacuum evacuated housing and at least a portion of the actuator is located within the vacuum evacuated housing, without the use of vacuum bellows, such that movement of the first contact relative to the second electrode consummate with a switching function occurs solely within the vacuum evacuated housing; wherein, the actuator comprises a magnetic actuator including a magnetizable core portion disposed at least partially within the vacuum evacuated housing.

7. The alternating current vacuum switching device of claim 6, wherein the magnetizable core portion comprises limbs extending into the vacuum evacuated housing.

8. The alternating current vacuum switching device of claim 6, wherein the magnetizable core portion comprises a wire-wound base portion.

9. The alternating current vacuum switching device of claim 8, wherein the base portion is outside the vacuum evacuated housing.

10. The alternating current vacuum switching device of claim 6, wherein the magnetizable core portion is entirely disposed within the vacuum evacuated housing.

11. The alternating current vacuum switching device of claim 6, wherein the magnetizable core portion comprises an E-shaped core portion.

* * * * *